US005333842A

United States Patent [19]

Stomp et al.

[11] Patent Number: 5,333,842

[45] Date of Patent: Aug. 2, 1994

[54] APPARATUS FOR SUPPLYING MEDIA TO A BLOWING LANCE

[75] Inventors: Hubert Stomp, Luxembourg-Howald; Andre Kremer, Leudelange; Daniel Fries, Arlon; Marc Reichert, Schifflange; Serge Devillet, Burden, all of Luxembourg

[73] Assignee: Paul Wurth S.A., Luxembourg

[21] Appl. No.: 3,232

[22] Filed: Jan. 11, 1993

[30] Foreign Application Priority Data

Jan. 24, 1992 [LU] Luxembourg ..... 88056

[51] Int. Cl.[5] ..... C21C 5/30

[52] U.S. Cl. ..... 266/226; 266/225

[58] Field of Search ..... 266/226, 225

[56] References Cited

U.S. PATENT DOCUMENTS

| | | | |
|---|---|---|---|
| 3,342,471 | 9/1967 | Preston | 266/226 |
| 3,480,267 | 11/1969 | Gregord | 266/226 |
| 3,501,136 | 3/1970 | Schweng | 266/226 |
| 5,200,136 | 4/1993 | Ramaseder | 266/226 |
| 5,217,674 | 6/1993 | Stomp | 266/226 |

FOREIGN PATENT DOCUMENTS

| | | |
|---|---|---|
| 0441767A2 | 1/1991 | European Pat. Off. . |
| 0464427A2 | 6/1991 | European Pat. Off. . |
| 69797 | 11/1974 | Luxembourg . |
| 3828928A1 | 4/1982 | Luxembourg . |
| 87425 | 12/1989 | Luxembourg . |
| WO90/05790 | 5/1990 | Luxembourg . |

*Primary Examiner*—Peter D. Rosenberg

*Attorney, Agent, or Firm*—Fishman, Dionne & Cantor

[57] ABSTRACT

An apparatus is provided for supplying media to a blowing lance, particularly a blowing lance used in the production of steel by a top blowing process. A vertically movable lance carrier comprises a media connection device having a vertical connection surface. Before coupling, the blowing lance is first locked on the lance carrier by a fastening device. The connection device is movable horizontally in guide rails on the lance carrier from a waiting position towards the coupling head of the blowing lance.

9 Claims, 2 Drawing Sheets

APPARATUS FOR SUPPLYING MEDIA TO A BLOWING LANCE

BACKGROUND OF THE INVENTION

The present invention relates to an apparatus for supplying media to a blowing lance, particularly a blowing lance used in the production of steel by a top blowing process. This invention comprises a vertically movable lance carrier, a substantially vertical connection surface on a connection device on the lance carrier, and a cooperating connection surface on the top part of the blowing lance. The two cooperating connection surfaces are able to be pressed one against the other during the coupling of the blowing lance to the connection device.

U.S. Pat. No. 4,893,791, U.S. Pat. No. 3,972,515, and the preliminary published application EP-O 464 427-A3, describe the fastening of a blowing lance on a vertically movable lance carrier having a horizontal media feed connection surface and the coupling of this horizontal media supply connection surface to a corresponding cooperating surface on a coupling head on the top part of the lance.

The important feature of the above-described prior art is that prior to effecting the actual coupling of the lance to the connection device, the lance is first rigidly fastened to the lance carrier. The swivelling and rocking movements of the lance encountered during transport of the lance to the lance carrier are thus largely suppressed. The top part of the lance is completely locked and immovable for the actual coupling. Prior to the present invention, the swivelling and tipping movements of the top part of the lance have had a destructive effect on the connection surfaces of the lance carrier, the coupling head and the coupling mechanism. The damage can be particularly great due to the lance's great length which means that the lance has considerable mass moments of inertia.

A major disadvantage in the above-described prior art relates to the horizontal connection surfaces. In order to insert the top part of the lance under the horizontal connection surface on the lance carrier, a transport bow must be provided between the crane hook for transporting the lance and the top part of the lance. Both the removal of this bow after insertion of the lance and the bow's attachment for the transport of the lance entail complicated manipulations. Furthermore, the lance approach corridor must have a greater width because the bow has to be of such a large minimum width.

In the preliminary published application EP-O 441 767-A2, an apparatus for supplying media to a blowing lance which has a vertical connection surface on the lance carrier is described. In this case, the lance is suspended in a horizontal translating device on the lance carrier. This device moves the lances horizontally in order to bring the cooperating connection surface on the top part of the blowing lance into contact with the vertical connection surface on the lance carrier and to press it into sealing contact. The lance may undergo rocking movements not only during the suspension of the lance on the translating device but also during the horizontal movement and during the coupling and uncoupling operations. Thus, there is a risk that the connection surfaces on the top part of the lance and/or on the connection device on the lance carrier will be damaged by uncontrolled collision.

SUMMARY OF THE INVENTION

The above-discussed and other drawbacks of the prior art are overcome or alleviated by the apparatus for supplying media to a blowing lance of the present invention. In accordance with the present invention, a fastening device provided on the lance carrier rigidly locks the blowing lance prior to the actual coupling operation. The connection device of the present invention is mounted on a carriage which is guided in horizontal guides on the lance carrier. This connection device is horizontally movable during the actual coupling and uncoupling operations.

After the lance has been rigidly locked by the fastening device on the lance carrier, the first vertical connection surface on the lance carrier is brought by horizontal movement of the connection device into contact with the immovable cooperating connection surface on the locked top part of the lance. The lance, with its considerable mass moments of inertia, thus remains immovable during the coupling operation, which is effected by moving the carriage guided in horizontal guides and carrying the connection device. During the uncoupling operation, the carriage carrying the connection device moves horizontally in the opposite direction, while the locking of the lance by the fastening device is released only after the connection device has reached its position of rest. Damage to the two connection surfaces during coupling and uncoupling operations through uncontrolled movements of the lance and the connection device is thus eliminated.

It will be appreciated that any mode of construction of the apparatus of this invention which can cooperate with the guides of the lance carrier that ensure substantially faultless horizontal guiding of the connection device is within the spirit and scope of this invention.

In a preferred embodiment, the connection device of this invention is provided with locking hooks which can engage with corresponding locking pins on the top part of the lance. With the aid of this locking device, the contact pressure between the two connection surfaces can be ensured and increased independently of the drive mechanism for the horizontal movement.

In a preferred embodiment having a less complicated construction, the fastening device on the lance carrier comprises a carrier flange in which the lance can be suspended by means of a collar. Swivellable and translatable hooks then engage with carrier pins on the lance and pull the latter towards the carrier flange, so that the lance is locked fast on the lance carrier.

Since the two connection surfaces are no longer exposed to the risk of uncontrolled collision during the coupling operation, these connection surfaces can now advantageously be made with concentric openings for the media conduits. This arrangement simplifies considerably the construction of the top part of the lance.

In order to ensure accurate guiding of the movable connection surface during coupling, the carriage is provided with guide rollers or slide guides which cooperate with the corresponding guide rails on the lance carrier.

The blowing lance of this invention can be picked up directly by a crane hook by means of a transport eye fastened on the top part of the lance as an extension of the longitudinal axis of the lance. Expensive transport bows associated with the prior art which are known from devices having horizontal connection surfaces, are thus no longer required.

The above-discussed and other features and advantages of the present invention will be appreciated and understood by those skilled in the art from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1:
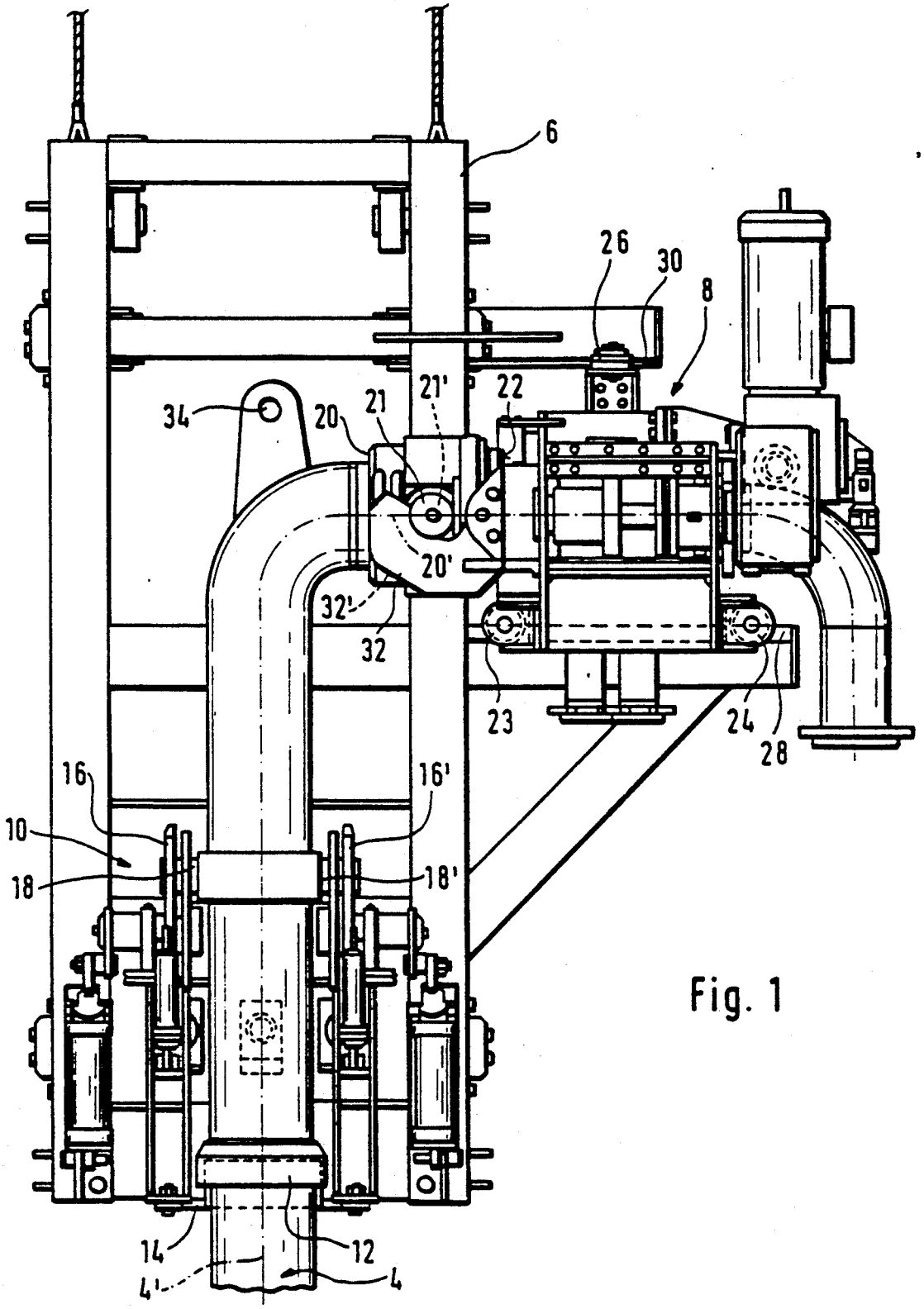
FIG. 1 is a front elevation view of a lance carrier with a blowing lance (shown partially) and a connection device.

In FIG. 1 the reference numeral 4 designates the top end of a blowing lance which has been laid and locked on a vertically movable lance carrier 6 and then tightly coupled to a connection device 8 for various media, for example gases and liquid coolants.

The fastening device 10 for fastening and locking the lance 4 on the lance carrier 6 comprises a lance collar 12, by means of which the lance can be suspended in a carrier flange 14 on the lance carrier 6, and of swivellable and translatable hooks 16, 16' provided on the lance carrier and able to engage with carrier pins 18, 18' on the lance 4. The hydraulically operated hooks 16, 16' pull the blowing lance 4 downwards against the carrier flange 14, so that rigid locking of the lance on the lance carrier is ensured.

The lance 4 is coupled by its top part or coupling head 20, the axis of which extends at right angles to the longitudinal axis 4' of the lance 4 and which has a preferably flat media supply connection surface 22, to a corresponding cooperating or coacting connection surface 34 on the connection device 8.

The connection device 8 is not rigidly connected to the lance carrier 6, but instead is mounted on a carriage which is guided by means of rollers 23, 24, 26 on horizontal guide rails 28, 30 on the lance carrier 6. For the purpose of coupling the locked, immovable coupling head 20 of the lance 4 to the connection device 8, the latter is moved, with the coupling hooks 32, 32' swivelled (e.g., pivoted) down, out of a waiting position (not shown) (in FIG. 1 on the right of the position shown) until the two media supply connection surfaces come into contact. The drive for the connection device may, for example, comprise a hydraulic linear drive or any other suitable drive means. The hooks 32, 32' are then swivelled or pivoted upwards to engage with corresponding coupling pins 21, 21' on the top part 20 of the lance and press the two connection surfaces facing one another firmly one against the other. The swivellable hooks 32, 32' are for example eccentrically mounted or are driven by means of a device such as that described, for example, in U.S. Pat. No. 4,893,291, all of the contents of which are incorporated herein by reference.

In an alternative embodiment of the present invention, the hooks 32, 32' are both swivellable and horizontally movable. During the coupling operation, the hooks 32, 32' are fist moved out and then swivelled onto the coupling pins 21, 21' on the top part 20 of the lance. The hooks 32, 32' then pull the connection device 8 with the connection surface 34 against the connection surface 22 on the top part of the lance. During the uncoupling operation, the hooks 32, 32' are supported on the coupling pins 21, 21' in order to press the connection device 8 into its waiting position. The return of the connection device 8 to its waiting position may however also be effected (or assisted) by springs or counterweights as soon as the hooks 32, 32' are disengaged from the pins 21, 21'.

As an extension of the longitudinal axis 4' of the lance 4, a transport eye 35 is fastened on the top part 20 of the lance and can be engaged by a crane hook (not shown). The lance can consequently be transported without an additional transport bow.

Figure 2:
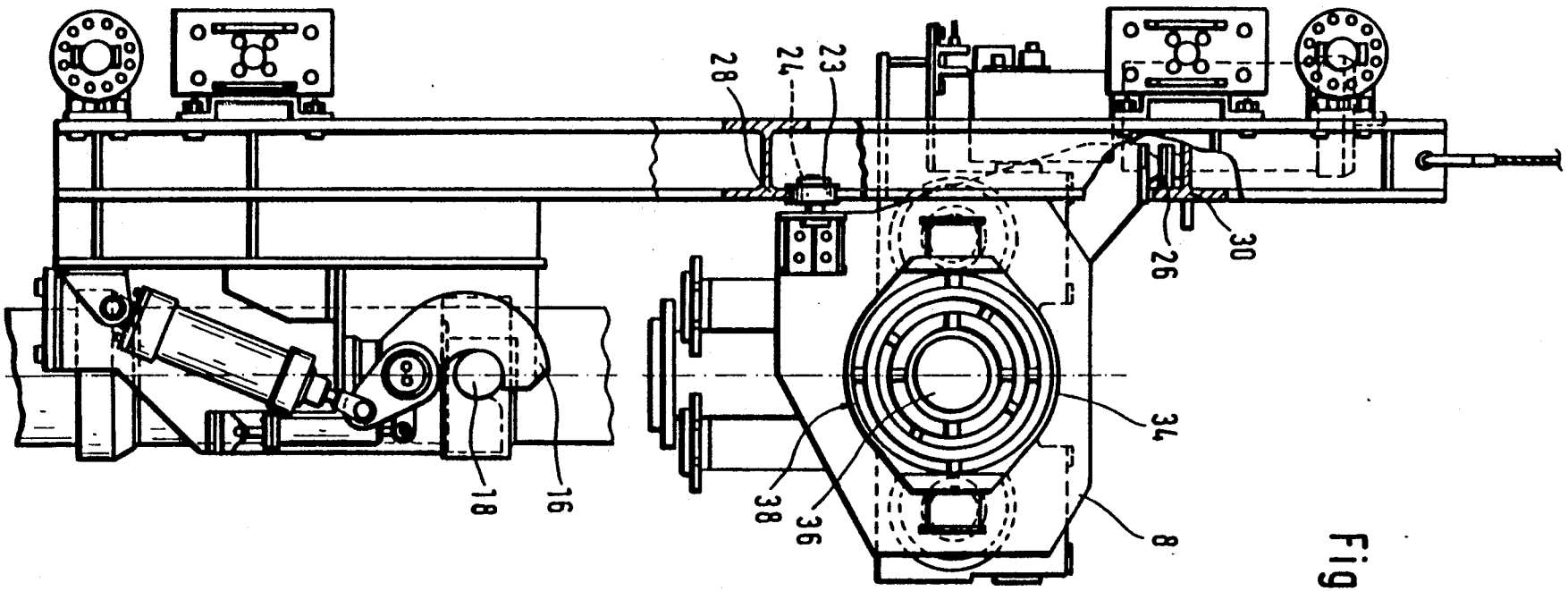
FIG. 2 is a side elevation view of the device shown in FIG. 1, with the top part of the lance being omitted.

In FIG. 2, the preferably flat connection surface 34 on the media connection device 8 can be seen. In a preferred embodiment it has a central, preferably circular opening 36 and a plurality of concentric annular openings between which sealing zones 38 are provided. These openings cooperate with corresponding openings in the connection surface 22 of the lance head 20 in order to make the connection of the blowing lance to the media supply. Such a configuration of the media passage surfaces has given excellent results in previous experience with horizontal surfaces. In accordance with an important feature of the present invention, it can now also be realized with vertically disposed connection surfaces 22, 34 without incurring the risk of damage to the surfaces during the operation of coupling the lance to the connection device on the lance carrier.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. Apparatus for coupling a blowing lance to a media supply, said lance having a top part with a first lateral connection surface for said media, said apparatus comprising:

vertically movable lance carrier means for receiving and vertically moving said lance;

fastening means on said lance carrier means for rigidly locking said top part of said lance to said lance carrier means before the actual coupling operation, wherein said first connection surface defines a substantially horizontal coupling direction on said lance carrier means;

movable carriage means;

guiding means on said lance carrier means for guiding said movable carriage means in a direction which is parallel to said substantially horizontal coupling direction;

a second connection surface for said media, said second connection surface matching said first connection surface and being supported on said movable carriage means so that it can be brought in mated contact with said first connection surface by moving said guided carriage means in said substantially horizontal coupling direction; and connection means on said movable carriage means for connecting said second connection surface to said media supply for the lance.

2. Apparatus according to claim 1 wherein said carriage means includes:

locking hooks which can engage with corresponding locking pins on an upper portion of a lance.

3. Apparatus according to claim 1 wherein said fastening means on said lance carrier means includes:

carrier flange means for engaging with a collar on a lance; and swivellable and translatable hooks which can engage with carrier pins on a lance.

4. Apparatus according to claim 1 wherein:

said first and second connection surfaces have a central opening and a plurality of concentric annular openings for the passage of media.

5. Apparatus according to claim 4 wherein:

all the openings in a connection surface lie in one plane.

6. Apparatus according to claim 1 wherein:

said carriage means is mounted on rollers which are guided in horizontal guide rails.

7. Apparatus according to claim 1 wherein:

said carriage means includes slide guides.

8. Apparatus according to claim 1 including:

a transport eye fastened on an upper part of a lance as an extension of the longitudinal axis of the lance.

9. Apparatus according to claim 1 wherein:

said second connection surface is immovable.

* * * * *